US005934021A

United States Patent [19]

Conway

[11] Patent Number: 5,934,021

[45] Date of Patent: Aug. 10, 1999

[54] PIVOTABLE SAFETY GATE

[76] Inventor: James M. Conway, 9 Woodcrest Rd., Manchester, Mass. 01944

[21] Appl. No.: 09/006,421

[22] Filed: Jan. 13, 1998

Related U.S. Application Data

[60] Continuation of application No. 08/697,037, Aug. 19, 1996, abandoned, which is a division of application No. 08/342,590, Nov. 21, 1994, Pat. No. 5,546,703.

[51] Int. Cl.[6] ..... E05D 15/22

[52] U.S. Cl. ..... 49/197; 49/73.1; 49/122

[58] Field of Search ..... 49/68, 73.14, 42, 49/197, 203, 381, 388, 506, 93, 95, 96, 97, 104, 105, 108, 109, 110, 112, 114, 116, 118, 119, 120, 204, 122; 52/64, 174, 74; 47/17

[56] References Cited

U.S. PATENT DOCUMENTS

| | | | |
|---|---|---|---|
| 659,117 | 10/1900 | White et al. | 52/64 |
| 2,874,819 | 2/1959 | Nutter | 49/68 |
| 3,421,260 | 1/1969 | Dickinson | 49/122 |
| 3,497,998 | 3/1970 | Thomas | 49/197 |
| 4,014,133 | 3/1977 | Brown | 47/17 |
| 4,150,510 | 4/1979 | Harrison et al. | 49/388 |
| 4,538,379 | 9/1985 | Vargo | 49/381 |
| 4,580,413 | 4/1986 | Klee | 62/380 |
| 5,701,701 | 12/1997 | Desrosiers | 49/122 |

*Primary Examiner*—Daniel P. Stodola
*Assistant Examiner*—Curtis Cohen
*Attorney, Agent, or Firm*—Don Halgren

[57] ABSTRACT

A pivotable safety gate having a pair of spaced apart parallel support frames which each have a distal end and a proximal end. The frames each have a support stanchion which is disposed adjacent the proximal end of the frame. The stanchions support a pivotable pair of gates. When one gate is down, the other gate is up. This gate assembly is utilizable at mezzanine floors where security and safety at edges of those floors are important. The gates prevent accidents and improper entry into areas which should be off limits to passage.

7 Claims, 2 Drawing Sheets

PIVOTABLE SAFETY GATE

This is a continuation of application Ser. No. 08/697,037 filed on Aug. 19, 1996, now abandoned, which is a divisional of Ser. No. 08/342,590 filed on Nov. 21, 1994, now U.S. Pat. No. 5,546,703.

BACKGROUND OF THE INVENTION

1. Field of the Invention

This invention relates to safety gates, and more particularly to mezzanine-type gates at guardrails.

2. Prior Art

Multiple levels and storage or manufacturing facilities often have intermediate or mezzanine floors which provide passageways for goods going to other levels. Railings and chains typically provide the safety on the periphery of these areas.

An early attempt at a gate or entrance arrangement is shown in U.S. Pat. No. 4,041,646 to Mittag. With these arrangement, one or two gates may be pivoted about a pair of lower pivot points to provide an opening, or to deny access to an entryway. A further gate for mezzanines is shown in U.S. Pat. No. 4,538,379 to Vargo. With this gate, a pair of parallel rails pivoted about a pair of opposed axes have a gate at one end thereof. The rails and gate define a generally rectangular area. When the gate is closed the gate portion is at one side of the frame assembly. When it is desired to provide access to that gate area the entire assembly is pivoted about those axes, so that that one gate is now pivoted to the opposite side 180 degrees from its original position. When this particular side frame assembly is in its vertical orientation, there is in fact no gate or barrier to prevent access through or over the mezzanine floor.

U.S. Pat. No. 5,241,789 to Vacelet shows an apparatus for protecting an elevator shaft opening. The opening at the shaft door comprises a railing which is secured to the door by two hinged parallelogram linkages. The protective railing is movable between two horizontally spaced apart positions. The railing is extendable to adopt or adapt to different opening widths. The gates of the prior art, however, fail to adequately provide a loading space which is sealed off at least at one end while the other end is opened under all circumstances. With this prior art the gate could be opened so that an individual could pass, run or fall through both the load area as well as through the side of the mezzanine.

Therefore, gate arrangements for mezzanine platforms known to date, however, do not offer satisfactory protection to workers on that mezzanine floor or to those below that floor.

It is an object of the present invention to overcome the disadvantages of the prior art.

It is yet a further embodiment of the present invention, to provide a mezzanine gate assembly, which has a pair of barriers, one of which is always down when the other is up.

It is yet a further object of the present invention to provide a failsafe invention so that a barrier is always blocking the passageway from a mezzanine floor.

BRIEF SUMMARY OF THE INVENTION

The present invention provides a safety gate assembly for mezzanines or other elevated platforms to provide a solid barrier which satisfies safety regulations, and which barrier is always in place, blocking an opening for an entryway on a mezzanine floor. The gate assembly provides a pair of parallel spaced apart generally inverted U shaped frame portions which are mounted to the floor of the mezzanine. Each frame portion has parallel spaced apart legs on opposite ends connected by a horizontal bar, an intermediate bar and a lowermost bar between those spaced apart legs. A stanchion is disposed near one end of the uppermost horizontal bar on each of the upright siderail assemblies. Those upright stanchions on the spaced apart frame assemblies, are in alignment with one another. Each of those stanchions has a bore which is co-axial with the bore of its corresponding stanchion. A swingable frame gate assembly is disposed on a pivot axis disposed in the bore of each stanchion and between those two spaced apart stanchions on the upright frame sections at the edge of a mezzanine floor. The swinging gate assembly, comprises a pair of parallel rails, each connected by a tranverse bar. The transverse bar connecting the midpoints of each parallel rail, have the pivot axes thereon which pivotally engage each of the stanchions, so as to permit rockability of the side frames. Each end of the side frame rails has a gate disposed thereat. The gate is arranged at an obtuse angle with respect to the parallel side rails. When one gate at one end of the side rail assembly is in the vertical (lowermost) orientation, the other gate at the other end of the pair of side rail frame members is disposed at a horizontal (uppermost) orientation.

In operation, the pair of gates at each end of the parallel side rail assembly act as in a "see-saw" manner, one end going up as the other end goes down. The end gate going down in the vertical orientation, thus blocks and acts as a barrier between the supporting side frame assembly. When "that" end is lifted the other end goes from a horizontal disposition into a vertical disposition blocking the other end of the side rail frame assembly and acting as a barrier thereto.

Thus at no time is the space between the siderail support assembly open so as to permit a passage through a sidewall on a mezzanine floor.

It is to be noted that while the area between the support siderails is opened, the proximalmost (furthest gate from the edge of the floor) gate is above the floor area so as to prevent entrance into the area between the two opposed gates approaching from the mezzanine floor. When the proximalmost gate is brought downwardly, the edge opposed gate is lifted upwardly so as to swing fully out of the way of anyone reaching any cargo within that gate area.

The invention thus comprises a mezzanine gate assembly including a generally planar panel arranged on the distalmost gate, to provide blockage to weather when the distal gate is in a down orientation, and to provide a temporary roof above the gate assembly when the distal gate is in an up orientation. The door panel may have a lowermost edge which is lower than a lowermost edge of the distal gate, to permit the panel to function as an articulable roof extending beyond the gate assembly.

The invention also comprises a method of shielding a loading area of a mezzanine floor in a building from weather when a safety gate assembly is closed to outside access, and providing a roof over a safety gate assembly when it is open to outside access, comprising the steps of: arranging a pair of parallel spaced apart siderail assemblies perpendicular to the edge of a floor; pivotally supporting a pair gate assemblies comprising an inside gate and an outside gate on a air of parallel frame members having axes journalled on the siderail assemblies; and attaching a planar panel onto the outer gate, parallel thereto, so that the panel functions as a door of said building when the outer gate is down and that the panel functions as a roof when the outer gate is in its up orientation. The invention also includes the step of: extending the lower edge of the panel to a location below the lowermost edge of the outer gate, so as to provide an articulable roof over at least part of an area outside of the building.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
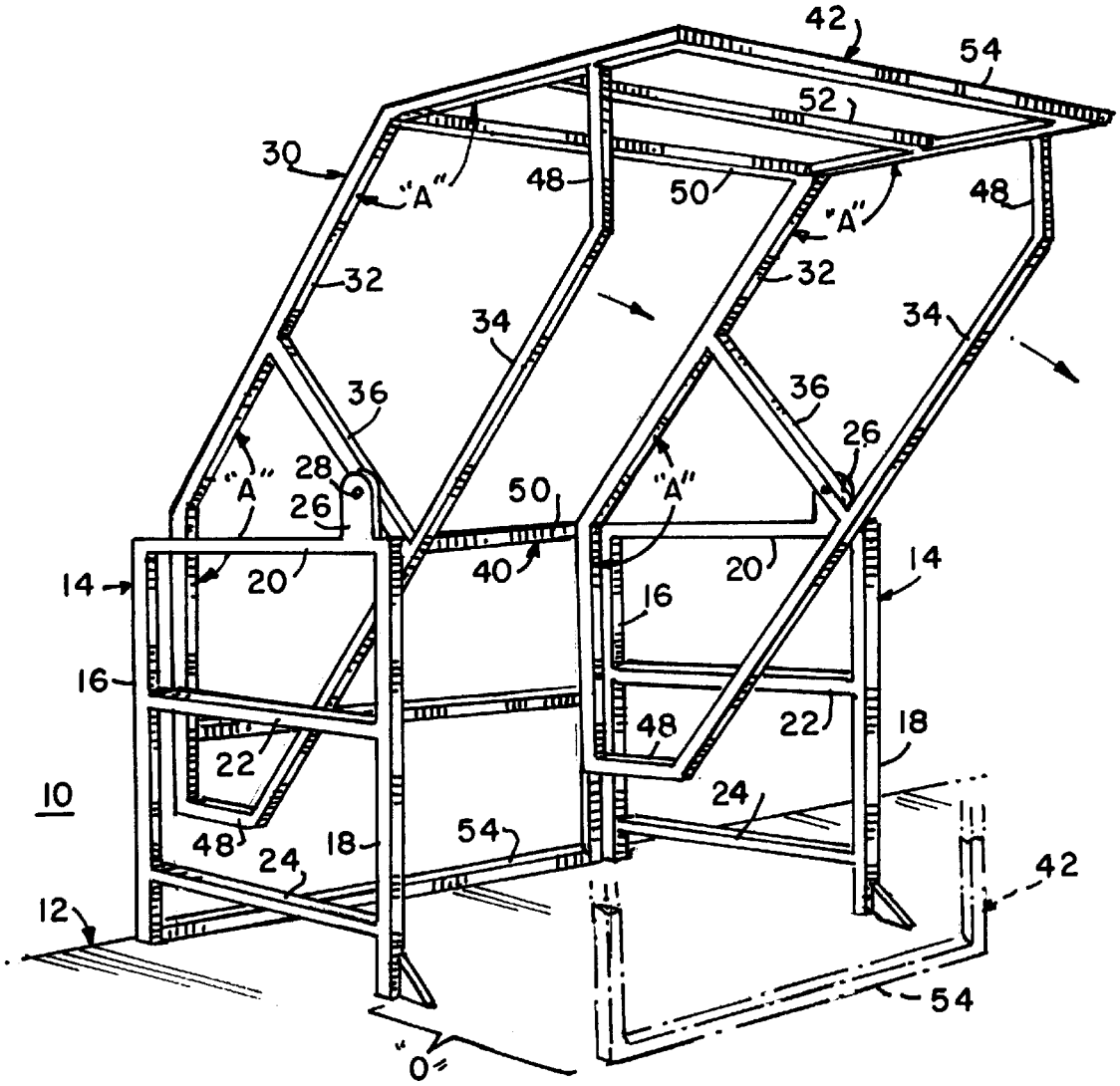
FIG. 1 is a perspective view of the safety mezzanine gate assembly, constructed according to the principles of the present invention.

Refering now to the drawings in detail, and paticularly to FIG. 1, there is shown a safety gate assembly 10 for mezzanines 12 or other elevated platforms to provide a solid barrier which satisfies safety regulations, and which barrier is always in place, blocking an opening for an entryway on a mezzanine floor. The gate assembly 10 provides a pair of parallel spaced apart generally inverted "U" shaped siderail assemblies 14 which are mounted to the floor of the mezzanine. Each siderail assembly 14 includes a pair of parallel spaced apart legs 16 and 18 on oppposite ends, connected by an upper horizontal bar 20, an intermediate horizontal bar 22 and a lowermost horizontal bar 24 connectively arranged between those spaced apart legs 16 and 18. A pivot stanchion 26 is disposed, critically, very near one end of the uppermost horizontal bar on each of the upright siderail assemblies 14 so as to have an an open space "O" alongside the siderails 14, when that particular "short" support proximal gate is in the "up" orientation. That is, there are no siderail assemblies to hinder access to the area within the gate assembly area 10, from a location inwardly of the pivot axis of the gates themselves, shown as an open space "O" in FIG. 1.

Figure 2:
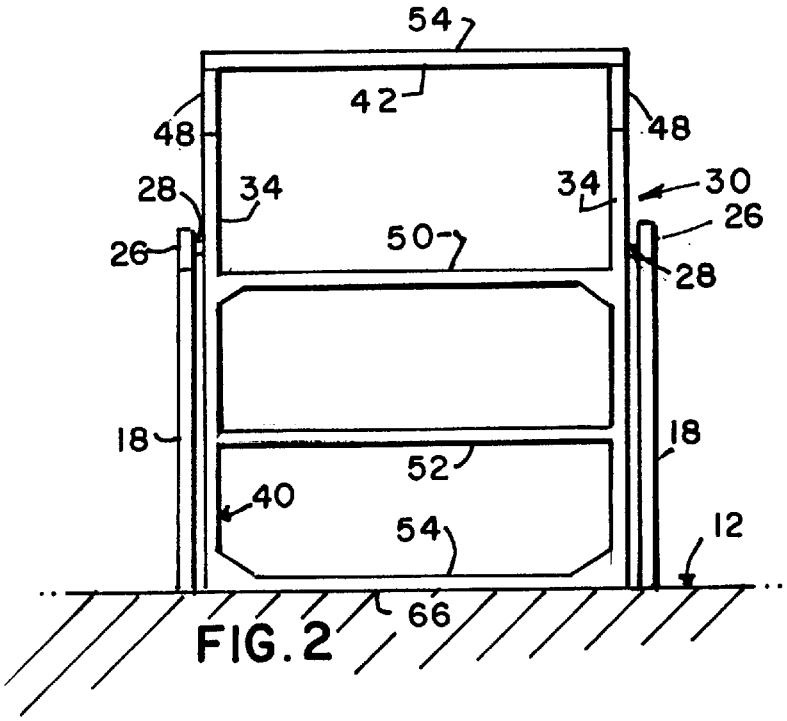
FIG. 2 is an end elevational view of the safety mezzanine gate.

Those upright stanchions 26 on the spaced apart siderail assemblies 14, are in alignment with one another. Each of those stanchions 26 has an bore 28 which is co-axial with the bore 28 of its corresponding stantion 26. A swingable frame gate assembly 30 is disposed between the two spaced apart stanchions 26 on the upright siderail assemblies 14 at the edge of a mezzanine floor 12. The swinging gate assembly 30 comprises an upper and a lower parallel rail 32 and 34, each connected at their mid-point by a tranverse bar 36. The transverse bar 36 connecting the mid-points of each parallel rail 32 and 34, has a pivot axis 38 extending from a lowermost side location thereon, as shown in FIG. 2, and engage the stanchions 26 so as to permit pivotability of the gate assembly 30 therebetween. Each end of the side frame rails 32 and 34 has a gate 40 and 42 disposed thereat. Each gate 40 and 42 is arranged at an obtuse angle "A" of about 135 degrees with respect to the longitudinal axis of each of the parallel side rails 32 and 34. Note that the lower side rail 34 has an extension rail 48 angularly disposed between each end of the rail 34 and its respective gate 40 and 42. When one gate 40 or 42 at one end of the side rail assemblies 14 is in the vertical (down) orientation, the other gate 42 or 40, at the other end of the pair of side rail frame assemblies 14 is disposed in the horizontal (up) orientation.

The "distal" gate 40 is defined as being adjacent the edge 15 of the mezzanine floor 12, and the "proximalmost" gate 42 is the one furthest from the edge 15. Each gate 40 and 42 has an uppermost transverse bar 50, a middle transverse bar 52, and a lowermost bar 54.

In operation, the gate 40 and 42 at each end of the parallel side rail assemblies 14 act as in a "see saw" manner, one end going up as the other end goes down. The end gate going down in the vertical orientation thus blocks and acts as a barrier between the supporting side frame assembly. When that end is lifted the other end goes from a horizontal disposition into a vertical disposition blocking the other end of the side rail frame assembly acting as a barrier thereto.

Figure 3:
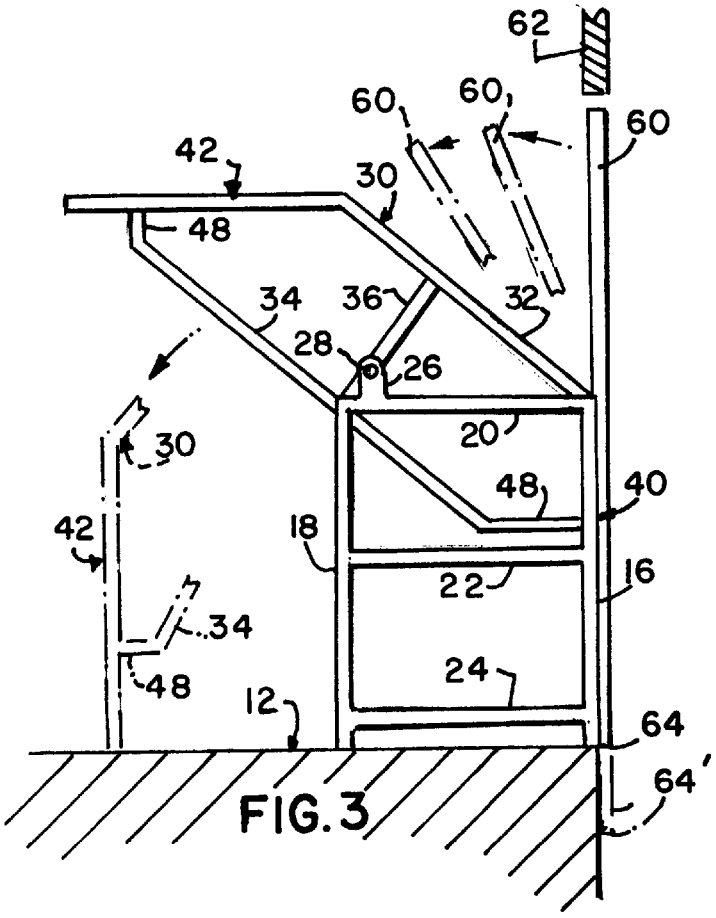
FIG. 3 is a side elevational view of the saftey mezzanine gate similar to that shown in FIG. 2, with an added door/roof arrangement therewith.

The location of the stanchions 26 at the "proximal" end of each of the side rail assemblies 14, which is the furthest away from the edge 15 of the mezzanine floor 12, as best seen in FIGS. 1 and 3, permits easy access to the area "O" proximal to the pivot support on the side rail assemblies 14.

Thus at no time is the space between the siderail support assembly open so as to permit a passage through a sidewall on a mezzanine floor, whether the distal gate 40 is down or the proximal gate 42 down.

It is to be noted that while the area between the support siderails is opened for full side and proximal access to the area between the siderails 14 from the proximal side thereof, the proximalmost gate is above the floor area so as to permit entrance into the area between the two opposed siderails 14. When the proximalmost gate 42 is brought downwardly, the "distal" gate 40, closest to the floor edge 15, is lifted upwardly so as to swing fully out of the way of anyone reaching any cargo within that gate area.

FIG. 1 shows the proximalmost gate 42, partially in phantom, in its lower down position, indicating the lack of siderail blockage proximal of the pivot axis location, when the proximal gate 42 is up.

A further embodiment is shown in FIG. 3, wherein a planar door panel 60 is shown attached to the distal gate 40, in a particularly usefull function when the gate assembly 10 is at the side of a building wall 62. The door panel 60 thereby automatically closes when the outer or "distal" gate is down, thus protecting the inside of the building from harsh weather. When the distal gate 40 is up and open, the door panel has moved from a vertical orientation to a horizontal orientation corresponding to the orientation of the distal gate, so as to function as a roof, keeping harsh weather off of the "protected" area between the siderail assemblies 14. If the door panel 60 has a lowermost edge 64 which is lower than the lowermost edge 66 of the distal gate 40, such as shown as 64', the door panel 60 could also function as an articulable roof over at least part of the loading area outside of and adjacent to the building.

Thus what has been disclosed is a novel safety gate arrangement which permits access to a defined "protectable" area, yet prevents undesired access to that area when personnel should not be there. The gate assembly also provides a door-like shelter when a panel is arranged to the distalmost gate in its down orientation and a roof-like shelter when that gate is in its up horizontal orientation.

I claim:

1. A mezzanine gate assembly for the safe enclosure and access to a loading and unloading area comprising:

a pair of parallel siderail assemblies, each siderail assembly including a plurality of spaced apart horizontal bars thereon to permit viewing therebetween, said horizontal bars having a first end and a second end;

a pivotable gate assembly including a first gate and a second gate connected by a pair of parallel rails, each of said gates arranged transverse to said siderail assemblies, and mounted for arcuate pivotable movement on said siderail assemblies;

a gate assembly support axis arrangement disposed above said siderail assemblies, between said first end and said second end thereof, to allow pivoting of said first and second gates and thus permit easy access to the area between said siderail assemblies at said end gates when in an up orientation, and to restrict access to the area between said siderail assemblies at said gates when in a down orientation.

2. The mezzanine gate assembly as recited in claim 1, wherein said horizontal bars comprise an arrangement of parallel bars spaced between a pair of generally vertically disposed legs.

3. The mezzanine gate assembly as recited in claim 2, wherein said parallel bars in said siderail assemblies are spaced apart to permit safe viewing of said enclosed area whether said first end gate is up or down.

4. The mezzanine gate assembly as recited in claim 3, wherein said first and said second gates are comprised of parallel, spaced apart elongated bars, to permit safe viewing of said enclosed area between said siderail assemblies.

5. The mezzanine gate assembly as recited in claim 4, wherein said second gate has a door panel thereon, which door panel acts as a roof over said gate assembly when said second gate is in an up orientation.

6. A mezzanine gate assembly for the safe enclosure and access to a mezzanine loading and unloading area comprising:

a pair of siderail assemblies having horizontal, spaced apart bars thereon, said horizontal bars having a first end and a second end;

a pivotable gate assembly including a first gate and a second gate arranged transverse to said siderail assemblies, and mounted for arcuate pivotable movement on a support axis arrangement secured over said horizontal bars of said siderail assemblies;

said gate assembly support axis arrangement disposed over said siderail assemblies, between said first end and said second end thereof, to allow pivoting of said first and second gates and thus permit easy access to the area between said siderail assemblies when one of said end gates is in the up orientation; wherein said siderail assemblies comprise an arrangement of parallel bars spaced between a pair of generally vertically disposed legs; and wherein said parallel bars in said siderail assemblies are spaced apart to permit safe viewing of said enclosed area whether said first end gate is up or down.

7. The mezzanine gate assembly as recited in claim 6, wherein said support axis arrangement is attached to said horizontal bars.

* * * * *